US006922539B2

(12) United States Patent
Uyama et al.

(10) Patent No.: US 6,922,539 B2
(45) Date of Patent: Jul. 26, 2005

(54) PROCESS CARTRIDGE AND IMAGE FORMING APPARATUS IN WHICH THE CONTACT WIDTH OF A DEVELOPER CHARGER WITH AN IMAGE BEARING MEMBER IS GREATER THAN OR EQUAL TO THE SUM OF THE DEVELOPING WIDTH OF DEVELOPING MEANS AND THE WIDTH OF MOVEMENT OF THE DEVELOPER CHARGER

(75) Inventors: Masao Uyama, Shizuoka (JP); Masahide Kinoshita, Shizuoka (JP); Masaki Ojima, Shizuoka (JP); Motoki Adachi, Shizuoka (JP); Kazuhiro Okubo, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/668,280

(22) Filed: Sep. 24, 2003

(65) Prior Publication Data

US 2004/0120729 A1 Jun. 24, 2004

(30) Foreign Application Priority Data

Sep. 27, 2002 (JP) ..... 2002-283955

(51) Int. Cl.[7] ..... G03G 15/00; G03G 21/00

(52) U.S. Cl. ..... 399/129; 399/71; 399/149; 399/343; 399/353

(58) Field of Search ..... 399/128, 129, 399/149, 150, 343, 349, 353, 354, 71, 111; 15/256.5, 256.51, 256.52, 256.53

(56) References Cited

U.S. PATENT DOCUMENTS

| | | | | |
|---|---|---|---|---|
| 4,851,960 A | | 7/1989 | Nakamura et al. | 361/225 |
| 5,095,335 A | | 3/1992 | Watanabe et al. | 399/111 |
| 5,589,918 A | | 12/1996 | Oshida et al. | 399/114 |
| RE35,581 E | | 8/1997 | Nakamura et al. | 361/225 |
| 5,682,574 A | | 10/1997 | Oshida et al. | 399/64 |
| 5,740,494 A | * | 4/1998 | Shoji et al. | 399/71 |
| 5,765,077 A | | 6/1998 | Sakurai et al. | 399/176 |
| 6,188,852 B1 | | 2/2001 | Ojima et al. | 399/25 |
| 6,215,967 B1 | * | 4/2001 | Takeda et al. | 399/149 X |
| 6,421,512 B2 | | 7/2002 | Watanabe et al. | 399/149 |
| 6,496,664 B1 | | 12/2002 | Ogata et al. | 399/62 |
| 6,807,384 B2 | * | 10/2004 | Okubo et al. | 399/149 X |
| 2002/0057925 A1 | * | 5/2002 | Watanabe et al. | 399/129 |
| 2003/0091353 A1 | | 5/2003 | Hiroshima et al. | 399/25 |

FOREIGN PATENT DOCUMENTS

| | | | |
|---|---|---|---|
| JP | 63-149669 | | 6/1988 |
| JP | 2001-215799 | | 8/2001 |
| JP | 2002-099176 A | * | 4/2002 |
| JP | 2003-195684 A | * | 7/2003 |

* cited by examiner

*Primary Examiner*—Sophia S. Chen
(74) *Attorney, Agent, or Firm*—Fitzpatrick, Cella, Harper & Scinto

(57) ABSTRACT

A process cartridge includes an image bearing member, a developing device developing an electrostatic image on the member using developer to form a developer image on the member and a developer charger charging residual developer on the member disposed downstream of a transferring position at which the developer image is transferred onto a transfer destination member and upstream of a position at which the electrostatic image is formed on the member with respect to the moving direction of the member. The developer charger is in contact with the member and is movable in the longitudinal direction of the member upon charging the residual developer. L1+d≦L2 when L1 is the developing width of the developing device, L2 is the contact width of the developer charger with the member, and d is the width of movement of the developer charger in the longitudinal direction of the member.

39 Claims, 5 Drawing Sheets

PROCESS CARTRIDGE AND IMAGE FORMING APPARATUS IN WHICH THE CONTACT WIDTH OF A DEVELOPER CHARGER WITH AN IMAGE BEARING MEMBER IS GREATER THAN OR EQUAL TO THE SUM OF THE DEVELOPING WIDTH OF DEVELOPING MEANS AND THE WIDTH OF MOVEMENT OF THE DEVELOPER CHARGER

BACKGROUND OF THE INVENTION

1. Field of the Invention

The present invention relates to an image forming apparatus, such as a copying machine, a page printer or a facsimile machine that utilizes an electrophotography process or an electrostatic recording process. The present invention also relates to a process cartridge for use in the above-mentioned image forming apparatus.

2. Description of the Related Art

Conventionally, an image forming apparatus such as a copying machine, a printer or a facsimile machine that utilizes a transferring type electrophotography process is composed of an electrophotographic photosensitive member (a photosensitive member) generally in the form of a rotary drum, a charging apparatus (performing a charging process) for uniformly charging the photosensitive member with a predetermined polarity and at a predetermined electric potential, an exposure apparatus (performing an exposure process) serving as information writing means for forming an electrostatic latent image on the photosensitive member that has been subjected to the charging process, a developing apparatus (performing a developing process) for visualizing the electrostatic latent image having been formed on the photosensitive member with developer in the form of toner as a developer image (i.e. a toner image), a transferring apparatus (performing a transferring process) for transferring the toner image from the surface of the photosensitive member onto a transferring material such as a paper sheet, a cleaning apparatus (performing a cleaning process) for removing developer (referred to as residual toner or transfer residual toner) remaining more or less on the photosensitive member after the transferring process so as to clean the surface of the photosensitive member, and a fixing apparatus (performing a fixing process) for fixing the toner image on the transferring material. The electrophotography process (including charging, exposure, development, transferring, and cleaning) is repeatedly performed on the photosensitive member for image formation.

Generally, in the cleaning apparatus, there is provided a waste toner recovering container for accommodating the transfer residual toner that has been removed from the surface of the photosensitive member. Therefore, in order to provide an image forming apparatus with a long operating life, it is necessary to design this container to be large. This is not desirable from the viewpoint of downsizing of the apparatus.

In view of the above, there has been developed a cleanerless image forming apparatus that does not have a cleaning apparatus including a waste toner recovering container, in which the transfer residual toner remaining on the photosensitive member after the transferring process is removed and recovered from the surface of the photosensitive member in the developing apparatus by "cleaning simultaneous with developing".

The cleaning-simultaneous-with-developing process is a process performed during the developing process in the next or succeeding process, namely during the process for developing an electrostatic image after the photosensitive member is successively charged and the electrostatic image is formed by exposure, to recover transfer residual toner remaining on the photosensitive member after transferring. In that process, the transfer residual toner that is present on the area of the surface of the photosensitive member that should not be developed is recovered into the developing apparatus by application of a fog removing bias (i.e. a fog removing potential Vback defined as an electrical potential difference between the DC voltage applied to the developing apparatus and the surface potential of the photosensitive member).

With this process, the transfer residual toner is recovered or collected by the developing apparatus and reused for development of electrostatic latent images in the succeeding processes. Consequently, waste toner can be eliminated and the effort for maintenance of the apparatus can be reduced. In addition, its cleanerless structure is advantageous for downsizing of the image forming apparatus.

Referring to the charging device, recently, a roller-charging-type charger that utilizes a charging roller functioning as a contact charging member have been preferably used in place of a corona charger. The roller-charging-type charger is preferable for its stability in charging. In the roller-charging process, an elastic roller (i.e. a charging roller) having electroconductive properties is brought into pressure contact with a member to be charged and charging of the member to be charged is performed by application of a voltage to the roller.

As to this charging process, there has been proposed and put into practice, for example in Japanese Patent Application Laid-Open No. H63-149669, an AC charging process, in which a voltage consisting of a DC voltage equal to a desired surface potential Vd of the member to be charged and an AV voltage having a peak-to-peak voltage equal to or more than 2×Vth (Vth is a discharge-start voltage or a breakdown or threshold voltage) superimposed on the DC voltage is applied to a contact charging member. With the voltage averaging effect of the AC voltage, the degree of uniformity in the charge can be improved as compared to the DC charging process, so that the electrical potential of the member to be charged is substantially converged to Vd, that is the center of the peaks of the AC voltage.

In the case that the aforementioned contact charging apparatus is used as the charging apparatus for the photosensitive member in the cleanerless image forming apparatus in which transfer residual toner remaining on the photosensitive member after the transferring process is removed and recovered by the leaning simultaneous with developing when the transfer residual toner passes through a charging portion in the form of a contact-nip portion between the photosensitive member and the contact charging apparatus, transfer residual toner, especially reversely charged toner that has a charge polarity reverse to the normal polarity, can adhere to the contact charging apparatus to bring about toner contamination of the contact charging apparatus beyond an acceptable degree, so that a charging error might be caused.

This is because toner as a developer might include toner originally having a charge polarity reverse to the normal polarity mixed therein, though the amount thereof is small. In addition, even toner having a normal charge polarity can be reversed in its polarity by an influence of a transferring bias or separation electric discharge, or the charge amount of the toner can be reduced by static elimination.

As per the above, the transfer residual toner is a mixture of toner having a normal charge polarity, toner having a reversed polarity (i.e. reversely charged toner) and toner having relatively small charge amount. Among these toners, the reversely charged toner and the toner having a small charge amount are likely to adhere to the contact charging apparatus upon passing through the charging portion in the form of the contact-nip portion between the photosensitive member and the contact charging apparatus.

In addition, in order for the transfer residual toner remaining on the photosensitive member to be removed and recovered or collected by the leaning simultaneous with developing in the developing apparatus, it is necessary that the charge polarity of the transfer residual toner on the photosensitive member to be carried through the charging portion to the developing portion be normal and that the transfer residual toner have such a charge amount that allows development of electrostatic latent images on the photosensitive member. In some cases, reversely charged toner and toner having an inappropriate charge amount cannot be removed or recovered from the surface of the photosensitive member to the developing apparatus, so that they sometimes cause image errors.

In view of the above-described situations, the applicant of this patent application has proposed, as disclosed in U.S. Pat. No. 6,421,512, an image forming apparatus provided with developer charge amount control means serving as first developer charging means for charging residual developer disposed upstream of charging means serving as a charger for charging a photosensitive member and residual developer uniformalizing means serving as second developer charging means for charging residual developer disposed upstream of the developer charge amount control means and downstream of a transferring portion.

A DC voltage with normal polarity equal to or larger than the breakdown voltage is applied to the developer charge amount control means, so that transfer residual toner passing through it is charged with the normal polarity by a sufficient electric discharge. Thus, on the occasion that the photosensitive member is subjected to charging over the transfer residual toner in the charging process by the contact charging member, the transfer residual toner that has been charged with the normal polarity does not adhere to the contact charging member. In addition, the residual developer uniformalizing means disperses a patterned transfer residual toner image on the photosensitive member, which is carried from the transferring portion to the developer charge amount control means, over the surface of the photosensitive member to decompose the pattern. The dispersed (or distributed) transfer residual toner is then sufficiently charged with the normal polarity by the developer charge amount control means.

On the other hand, in the case that the developer charge amount control means and the residual developer uniformalizing means have electroconductive fiber brush portions and the transfer residual toner remaining on the photosensitive member is dispersed and distributed by those electroconductive fiber brush portions brought into contact with the photosensitive member, toner is sometimes fused to the surface of the photosensitive member to cause image errors.

The reason why toner is fused to the surface of the photosensitive member is considered as follows. Since the transfer residual toner having passed through the residual developer uniformalizing means and the developer charge amount control means has a high charge amount, through its polarity is normal, it is impossible to recover the transfer residual toner as it is in the developing apparatus. So, an AC voltage is applied to the contact charging apparatus, so that the charge amount of the transfer residual toner is controlled to be an appropriate amount by the static elimination effect of the AC voltage. However, even with such a countermeasure, local excessive charging of the transfer residual toner cannot be prevented in some cases. In that case, the mirroring force of the photosensitive member and the excessively charged transfer residual toner becomes so strong that the toner does not adhere to the contact charging member, cannot be recovered by the developing apparatus and cannot be transferred by the transferring means. As a result, the excessively charged transfer residual toner is fused to the surface of the photosensitive member.

In view of the above, the applicant (inventors) of the present patent application has proposed, as disclosed in Japanese Patent Application Laid-Open No. 2001-215799, an image forming apparatus provided with equipment for moving the developer charge amount control means and the residual developer uniformalizing means back and forth (this movement will be referred to as reciprocating movement hereinafter) in the longitudinal direction of the photosensitive member.

With the reciprocating movement of the developer charge amount control means and the residual developer uniformalizing means in the longitudinal direction of the photosensitive member, it was possible to avoid local excessive charging of the transfer residual toner positively and satisfactory images could be obtained without fusion of toner to the surface of the photosensitive member.

However, in the above-described image forming apparatus utilizing the leaning simultaneous with developing and the roller charging process, in the case that developer charge amount control means equipped with an electroconductive fiber brush portion is provided and the developer charge amount control means and the residual developer uniformalizing means are reciprocated, the following problems arise.

(1) When the reciprocating movement brings end faces (with respect to the axial direction of the photosensitive member) of the developer charge amount control means and the residual developer uniformalizing means to a position inside the range (or length) of the developer carrying portion of the developing apparatus, the following problem might arise.

The developing apparatus causes fog toner (i.e. toner that adheres to a non-image portion in which developer should not adhere) to adhere to the photosensitive member, though the amount of the fog toner is not large. The fog toner includes toner having a charge polarity reverse to the normal polarity and toner that has little charge. In addition, there is transfer residual toner on the photosensitive member after the transferring process, though the amount of the transfer residual toner not large. The transfer residual toner also includes toner having a charge polarity reverse to the normal polarity and toner that has little charge.

Consequently, in the case that end faces of the developer charge amount control means and the residual developer uniformalizing means are brought inside the range of the developer carrying portion of the developing apparatus in the course of the reciprocating movement, when the fog toner and the transfer residual toner are brought into direct contact with the contact charging member without passing through the developer charge amount control means and the residual developer uniformalizing means, such toner will adhere to the contact charging member to bring about toner contamination of the contact charging apparatus beyond an acceptable degree. As a result, a charging error might be caused.

(2) When the reciprocating movement brings end faces of the developer charge amount control means and the residual developer uniformalizing means inside the range of the developer carrying portion of the developing apparatus, toner adheres to the surface of the developer charge amount control means and the residual developer uniformalizing means. When the portion of those means at which toner has adhered is moved to a position outside the range of the developer carrying portion of the developing apparatus, the following problem might arise.

The fog toner or the transfer residual toner that has been brought to a position outside the range of the developer carrying portion of the developing apparatus has been controlled by the developer charge amount control means and the residual developer uniformalizing means to have a normal polarity and an appropriate charge amount. Consequently, such toner will scarcely adhere to the contact charging member, but cannot be recovered by the developing apparatus. As a result, toner adheres to and accumulates on the photosensitive member, so that problems such as toner scattering sometimes occur.

SUMMARY OF THE INVENTION

An object of the present invention is to provide an image forming apparatus and a process cartridge that are improved in ability of removing and recovering (or collecting) transfer residual developer utilizing developer charging means that is movable in the longitudinal direction of an image bearing member.

A further object of the present invention is to provide an image forming apparatus and a process cartridge that can suppress adhesion of developer to a charger to prevent formation of an abnormal image due to a charge error, even in the case that developer charging means is moved.

It is another object of the present invention to provide an image forming apparatus and a process cartridge that can suppress accumulation of developer to prevent developer scattering, even in the case that developer charging means is moved.

It is yet another object of the present invention to provide an image forming apparatus and a process cartridge in which transfer residual developer on an image forming member after a transferring process is prevented from passing through developer charging means without being subjected to the operation of developer charging means.

It is still another object of the present invention to provide an image forming apparatus and a process cartridge that is adapted in such a way that residual developer is charged to have an appropriate charge amount before the residual toner on an image bearing member reaches the charging position of a charger.

Further objects and features of the present invention will become apparent from the following description with reference to the accompanying drawings.

DETAILED DESCRIPTION OF THE PREFERRED EMBODIMENT

In the following, an image forming apparatus and a process cartridge according to the present invention will be specifically described with reference to the drawings.

Figure 1:
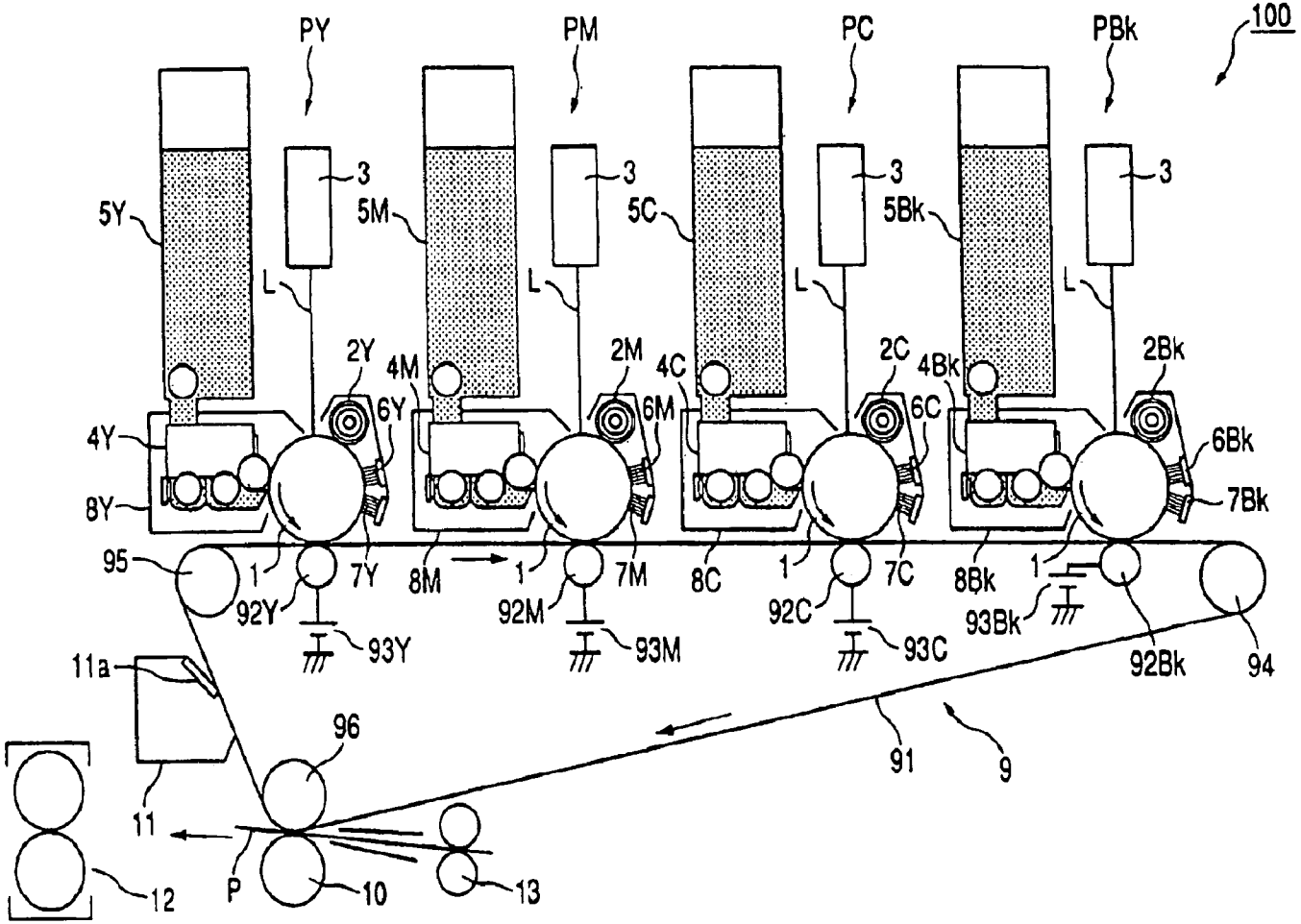
FIG. 1 is a cross sectional view schematically showing an embodiment of an image forming apparatus according to the present invention.

FIG. 1 schematically shows the structure of an embodiment of the image forming apparatus according to the present invention. The image forming apparatus 100 according to the present embodiment is a color laser printer with a maximum sheet size to be supplied with A-4 size recording material that utilizes a transferring-type electrophotography process, a contact charging process and a reversal development process. The image forming apparatus 100 can form full color images on transferring materials, such as paper sheets, OHP sheets or fabrics based on image information sent from an external host apparatus that is connected to the body of the image forming apparatus (or apparatus body) in such a way as to be capable of communicate with the apparatus body and output them.

The image forming apparatus 100 is an image forming apparatus of a four-drum system (in-line) equipped with a plurality of process cartridges 8, in which toner images are first sequentially transferred onto an intermediate transferring member 91 in an multi-layered mariner by the respective process cartridges 8, and then the toner images are transferred from the intermediate transferring member 91 onto a transferring material P at one time, so that a full color print image is formed. There are four process cartridges 8 disposed in series along the moving direction of the intermediate transferring belt 91 serving as the intermediate transferring member in the order of the yellow process cartridge, the magenta process cartridge, the cyan process cartridge and the black process cartridge.

In this embodiment, image forming portions (i.e. image forming stations) PY, PM, PC and PBk for the respective colors of yellow (Y), magenta (M), cyan (C) and black (Bk) serving as multiple image forming means have the same structure except that the colors of the developers used therein are different. Therefore, suffixes Y, M, C and Bk for indicating the respective image forming portions to which various elements belong will be omitted in the following description and the elements will be collectively described, unless a distinction is required.

Here, an overall operation of the image forming apparatus 100 upon forming, for example, a full color image by four color process will be described. Color separated image signals are generated based on a signal sent from an external host apparatus that is connected to the image forming apparatus 100 in such a way as to be capable of communicating with the image forming apparatus. Based on those image signals, toner images of the respective colors are formed in the respective process cartridges 8Y, 8M, 8C and 8Bk of the respective image forming portions PY, PM, PC and PBk. In each of the process cartridges 8Y, 8M, 8C and 8Bk, an electrophotographic photosensitive member (i.e. a photosensitive drum) 1 serving as an image bearing member (or image carrier members) is charged by charging means 2 serving as a charger, and the uniformly charged surface of the photosensitive drum 1 is subjected to scanning exposure by exposure means 3, so that an electrostatic latent image is formed on the photosensitive drum 1. The electrostatic latent image is supplied with toner as a developer by developing means 4, so that a toner image is formed. The toner images of respective colors thus formed on the respective photosensitive drums 1 are sequentially transferred onto the intermediate transferring belt 91, serving as a moving intermediate transferring member (or the second image bearing member), in a multi-layered (or superposed) manner. The full color toner image thus formed on the intermediate transferring belt 91 is transferred at one time onto a transferring material P that has been conveyed to a secondary transferring portion at which the intermediate transferring belt 91 and a secondary transfer roller 10, serving as a secondary transferring means, are opposed to each other. After that, the transferring material P is conveyed to fixing means 12, also called a roller fixing device, in which the toner image is fixed, and then discharged to the exterior of the apparatus.

In the following, elements in the image forming apparatus 100 will be more specifically described with additional reference to FIG. 2.

The image forming apparatus 100 has the electrophotographic photosensitive member of a rotary drum-type member (i.e. photosensitive drum) 1 serving as an image bearing member. In this embodiment, the photosensitive drum 1 is an organic photoconductor (OPC) drum having a longitudinal length of 370 mm and an outer diameter of 30 mm. The drum is driven to rotate about its central support shaft in the counterclockwise direction indicated by arrows inside drum 1 in FIGS. 1 and 2 at a process speed (in terms of the circumferential speed) of 100 mm/sec. The photosensitive drum 1 has the structure including an aluminum cylinder (or electroconductive drum base) the surface of which is coated with a primer layer for suppressing interference of light and improving adhesivity of the upper layer, a photo-charge generating layer and a charge transfer layer (having a thickness of 20 $\mu$m) in the mentioned order from the bottom, which three layers constitute a photosensitive layer. The longitudinal length of the coating portion that can be charged by a contact charging process (i.e. the chargeable portion) or the coating width is designed to be 340 mm.

In this embodiment, the image forming apparatus 100 has as charging means comprising a charging roller 2 in the form of a contact charger. A voltage that satisfies a predetermined condition is applied to the charging roller 2 so that the photosensitive drum 1 is uniformly charged with a negative polarity. The charging roller 2 has a three-layered structure including a bottom layer 2*b*, an intermediate layer 2*c* and a surface layer 2*d* layered on the outer surface of a metal core (or a supporting member) 2*a* in the mentioned order from the bottom. The bottom layer 2*b* is a foamed sponge layer for reducing the charging sound, the intermediate layer 2*c* is a resistance layer for realizing a uniform resistance of the charging roller 2 as a whole, and the surface layer 2*d* is a protect layer for preventing leakage in case a defect, such as a pin hole, is present on the photosensitive drum 1. In the charging roller 2 in this embodiment, the metal core 2*a* is a round rod made of a stainless steel having a diameter of 6 mm, and the surface layer is made of a fluorocarbon resin dispersed with carbon. The outer diameter of the charging roller 2 is 14 mm, the resistance of the roller is $10^4$ to $10^7\Omega$, and the longitudinal length of the charging portion (i.e. the operating portion) or the charging width is 320 mm.

The charging roller 2 is rotatably supported by bearing members at both end portions of the metal core 2*a* and biased toward the photosensitive drum 1 by a press spring so that the charging roller is in pressure contact with the surface of the photosensitive drum 1 with a predetermined pressurizing force. In addition, the charging roller is driven by the rotation of the photosensitive drum 1 so as to rotate. From an electric power source 20 functioning as a voltage applying means, a predetermined oscillating voltage in which a DC voltage and an AC voltage with a predetermined frequency are superimposed (a charging bias voltage from Vdc+Vac) is applied to the charging roller 2 via the metal core 2*a*, so that the circumferential surface of the rotating photosensitive drum 1 is charged up to a predetermined electric potential. The contact portion between the charging roller 2 and the photosensitive drum 1 constitutes a charging portion a.

In this embodiment, the charging bias voltage applied to the charging roller 2 is an oscillating voltage (or vibrating voltage) in which a DC voltage of −500V and a sinusoidal wave AC voltage with a frequency of 1150 Hz and a peak to peak voltage Vpp of 1400V are superimposed, so that the circumferential surface of the photosensitive drum 1 is charged up to −500V (the dark portion potential Vd) by the contact charging process.

A charging roller cleaning member 2*f* is provided for the charging roller 2. In this embodiment, the charging roller cleaning member 2*f* is a cleaning film having elasticity, and the longitudinal length of it is designed to be 330 mm. The cleaning film 2*f* is disposed parallel to the longitudinal direction of the charging roller 2, and one end of the cleaning film 2*f* is fixed to a supporting member 2*g* that reciprocates in the longitudinal direction with a constant stroke. The cleaning film 2*f* is disposed in such a way that its surface near the free end forms a contact nip with the charging roller 2. In this embodiment the cleaning film 2*f* is reciprocated with a stroke of 6 mm. The supporting member 2*g* is driven by a driving motor of the image forming apparatus 100 via a gear train to reciprocate in the longitudinal direction with a constant stroke. Thus, the cleaning film 2*f* slides in contact with the surface layer 2*d* of the charging roller 2. As a result, contaminators (such as fine powder toner or external additive) adhering on the surface layer 2*d* of the charging roller 2 are removed. In addition, in order to return toner from the charging roller 2 to the photosensitive drum 1 in the case that toner adheres to the charging roller 2, it is desirable that the cleaning film 2*f* triboelectrically charges the toner adhering to the charging roller 2 with a normal charge polarity (i.e. the minus).

After the photosensitive drum 1 is uniformly charged by the charging roller 2 up to a predetermined potential with predetermined polarity, the photosensitive drum 1 is subjected to image exposure L by image exposure means (including color separating and imaging optical systems for color original images, a scanning exposure system utilizing laser scanning for outputting a laser beam that is modulated in accordance with a time-series electrical digital pixel signal of image information etc.). Thus, electrostatic latent images of a target color image corresponding to the color components of the respective image forming portions PY, PM, PC and PBk are formed. In this embodiment, a laser beam scanner 3 utilizing a semiconductor laser is used as exposure means. The laser beam scanner 3 outputs a laser beam that is modulated in accordance with an image signal sent from a host apparatus such as an image reading apparatus (not shown in the drawings) to the image forming apparatus 100 to perform laser scanning exposure (or image exposure) of the uniformly charged process surface of the rotating photosensitive drum 1. With the laser scanning exposure, the electrical potential of the area of the surface of the photosensitive drum 1 that has been irradiated with the laser beam L drops, so that an electrostatic latent image corresponding to the image information used in the scanning exposure is formed on the surface of the photosensitive drum 1. In this embodiment, the electrical potential of the exposed area is −150V. The position on the photosensitive drum 1 that is irradiated with image exposure light L is referred to as an exposure portion b.

Then, the electrostatic latent image formed on the photosensitive drum 1 is developed with toner by the developing device 4 serving as developing means. The developing device 4 used in this embodiment is a two-component contact developing device (i.e. a two component magnetic brush developing device). The developing device 4 is equipped with a developing container (the main body of the developing device) 40, a developing sleeve 41 functioning as a developer carrying member having a magnet roller fixedly provided in the interior thereof, a developer regulation blade 42 serving as a developer regulating member, two-component developer (developer) 46 as a mixture including mainly resin toner particles (toner) and magnetic carrier particles (carrier) and developer agitating members 43 and 44 disposed at the bottom of the developing container 40.

The developing sleeve 41 is rotatably provided in the interior of the developing container 40 with a part of its outer circumferential surface being exposed to the exterior of the developing container 40. The outer diameter of the developing sleeve 41 is designed to be 16 mm and the longitudinal length (or the developing width) of the developer carrying portion (i.e. the portion coated with developer) is designed to be 310 mm. The developer regulation blade 42 is opposed to the developing sleeve 41 with a predetermined gap (250 μm) between them, so that a thin layer of developer is formed on the developing sleeve 41 as the developing sleeve rotates in the direction indicated by an arrow in FIG. 2). In this embodiment, the developing sleeve 41 is disposed closely opposed to the photosensitive drum 1 with the minimum distance (S-D gap) being maintained to be 400 μm. The portion at which the photosensitive drum 1 and the developing sleeve 41 are opposed to each other is referred to as a developing portion c.

The developing sleeve 41 is driven to rotate in the direction at the developing portion c reverse to the traveling direction of the photosensitive drum 1 at a circumferential speed 1.7 times as high as the circumferential speed of the photosensitive drum 1. The thin layer of the developer on the developing sleeve 41 is in contact with the surface of the photosensitive drum 1 at the developing portion c, so that the thin layer of the developer slides in contact with the photosensitive drum 1 appropriately. A predetermined developing bias voltage is applied to the developing sleeve by an electrical power source (not shown) serving as voltage applying means. In the case of this embodiment, the developing bias voltage applied to the developing sleeve 41 is an oscillating voltage in which a DC voltage (Vdc) and an AC voltage (Vac) are superimposed. More specifically, it is an oscillating voltage in which a DC voltage Vdc of −350V and an AC voltage Vac of 1800 Vpp with a frequency of 2300 Hz are superimposed.

As per the above, the surface of the rotating developing sleeve 41 is coated with the thin layer of the developer 46, and toner contained in the developer delivered to the developing portion c selectively adheres, with the aid of an electric field generated by the developing bias voltage, to the photosensitive drum 1 in accordance with the electrostatic latent image formed on the photosensitive drum 1. Thus, the electrostatic latent image is developed as a toner image. In the case of this embodiment, toner adheres to the exposed bright portion on the photosensitive drum 1, so that the electrostatic image is reversal-developed. The thin layer of the developer on the developing sleeve having passed through the developing portion c is returned to a developer pool in the developing container 40 as the developing sleeve 41 further rotates.

Furthermore, agitating screws 43 and 44 serving as developer agitating members are provided in the interior of the developing device 4. The agitating screws 43 and 44 are rotated in synchronization with the rotation of the developing sleeve 41. The agitating screws 43 and 44 function to agitate supplied toner so as to mix the toner with carrier so that a predetermined charge is given to the toner. In addition, the agitating screws 43 and 44 carry the developer 46 in the opposite directions along the longitudinal direction to supply the developing sleeve 41 with the developer 46 and function to carry the developer 46 that has been lowered in toner concentration (i.e. the proportion of the toner in the developer) through the developing process to a toner replenishing portion so as to cause the developer 46 to circulate in the developing container.

On the wall of the developing device 4 and at a position upstream of the screw 44, there is provided a toner concentration sensor 45 for sensing the toner concentration of the developer 46 by detecting a variation in the magnetic permeability of the developer. A toner replenishing opening 47 is provided at a position slightly downstream of the toner concentration sensor 45 with respect to the circulating direction of the developer 46. After the developing operation, the developer 46 is carried to the position of the toner concentration sensor 45, at which the toner concentration is detected. Based on the result of the detection, toner is supplied fitly from a developer replenishing container (i.e. a toner replenishing unit) 5 connected to the developing device 4 through the toner replenishment opening 47 by virtue of rotation of a screw 51 equipped in the toner replenishing unit 5. The supplied toner is carried by the agitating screw 44 so as to be mixed with carrier and imparted with appropriate charge, and then carried to the vicinity of the developing sleeve 41, on which the toner is formed into a thin layer so as to be used for development.

The toner used in this embodiment is a negatively charged toner with an average particle diameter of 6 μm and the carrier is a magnetic carrier with a saturation magnetization of 205 emu/cm$^3$ and an average particle diameter of 35 μm. The developer is a mixture including the toner and the carrier with a ratio of 6:94. The charge amount of the toner used for development on the photosensitive drum 1 is −25 μC/g.

An intermediate transferring unit 9 serving as transferring means is provided in such way as to be opposed to the photosensitive drums 1 of the respective image forming portions PY, PM, PC and PBk. The intermediate transferring unit 9 includes the endless intermediate transferring belt 91 serving as an intermediate transferring member (or the second image bearing member) that is looped around a driving roller 94, a tension roller 95 and a secondary transfer opposed roller 96 with a predetermined tension. The intermediate transferring belt 91 moves in the direction indicated by an arrow adjacent the belt 91 in FIG. 1.

The toner image formed on the photosensitive drum 1 enters a primary transfer nip portion (transferring portion) z at which the photosensitive drum 1 and the intermediate transferring belt 91 are opposed to each other. In the transferring portion z, a primary transfer roller 92 serving as primary transferring means abuts the backside of the intermediate transferring belt 91. The primary transfer roller 92 is made of an electroconductive sponge that is designed to have a resistance of $10^6\Omega$ and an outer diameter of 16 mm. The longitudinal length of the abutting portion (i.e. the operating portion) is designed to be 330 mm. Primary transferring bias power sources 93, serving as voltage applying means, are connected to the respective primary transfer rollers 92 so that primary transferring bias voltages can be applied in the respective image forming portions PY, PM, PC and PBk independently from each other. A yellow toner image formed on the photosensitive drum 1 of the first (yellow) image forming portion PY in accordance with the above-described process is transferred onto the intermediate transferring belt 91 first, and toner images of magenta, cyan and black formed by the same process are transferred from the photosensitive drums 1 of the respective colors onto the intermediate transferring belt 91 in the respective image forming portions PM, PC and PBk in a multi-layered manner.

In this embodiment, a primary transferring bias voltage of +350V is applied for all of the first to fourth colors taking into account the transfer efficiency of the toner transferred to the exposed portion (with an exposed portion potential V1 of −150V). The color image composed of four colors formed on the intermediate transferring belt 91 is then transferred by a secondary transfer roller 10, serving as secondary transferring means, at one time onto a transferring material P that has been fed from transferring material feeding means (not shown) and delivered from sheet feed rollers 13 serving as conveying means at a predetermined timing.

The transferring material P on which the toner image has been transferred is then conveyed to a roller fixing device 12 serving as fixing means, in which the toner image is fused and fixed on the transferring material by heat and pressure. After that, the transferring material P is discharged to the exterior of the apparatus. Thus, a color print image is obtained.

As a material for the intermediate transferring belt 91, an extendable material is not appropriate, but a resin belt, a rubber belt including a metal stiffener or a belt made of a resin and a rubber is desirable in order to realize good registration in the image forming apparatus PY, PM, PC and PBk of respective colors. In this embodiment, a resin belt made of a polyimide (PI) that is dispersed with carbon so that the volume resistivity is controlled to be of an order of $10^8\Omega\cdot$cm is used. The belt has a thickness of 80 $\mu$m, a longitudinal length of 390 mm and a circumferential length of 900 mm.

Secondary transfer residual toner remaining on the intermediate transferring belt 91 is cleaned by a cleaning blade 11*a* serving as cleaning means equipped in an intermediate transferring belt cleaner 11 in preparation for the next image forming process. The longitudinal length of the abutting portion (i.e. the operating portion) of the cleaning blade is designed to be 330 mm.

Furthermore, each of the image forming portions PY, PM, PC and PBk is provided with developer charge amount control means (or the first developer charging means) 6 and residual developer uniformalizing means (or the second developer charging means) 7, each of which is in contact with the photosensitive drum 1. In this embodiment, both the developer charge amount control means 6 and residual developer uniformalizing means comprise brushes made of electroconductive fibers. More specifically, the developer charge amount control means 6 includes a transversely extending electrode plate 62 on which a brush portion (i.e. an operating portion) 61 is provided. The residual developer uniformalizing means 7 also includes an electrode plate 72 on which a brush portion (i.e. an operating portion) 71 is provided. The brush portions 61 and 71 are arranged to be in contact with the surface of the photosensitive drum 1.

The resistance values of the brush portions 61 and 71 of the developer charge amount control means 6 and the residual developer uniformalizing means 7 are controlled by including carbon or a metal powder in a fiber such as rayon, acrylic or polyester. It is preferable that the brush portions 61 and 71 have a bristle size equal to or less than 30 denier and a density of 10,000 to 500,000 number/inch$^2$ in order that they can abut the surface of the photosensitive drum 1 and the transfer residual toner uniformly. In the case of this embodiment, the brush portions 61 and 71 have a bristle size of 6 denier and a density of 100,000 number/inch$^2$, a bristle length of 5 mm and a volume resistivity of the brush portions of $6\times10^3\Omega\cdot$cm.

The developer charge amount control means 6 and the residual developer uniformalizing means 7 are disposed substantially parallel with the longitudinal direction of the photosensitive drum 1 and fixed to a supporting member 79 that is adapted to move back and forth (i.e. reciprocate) in the longitudinal direction by a constant stroke so that the brush portions 61 and 71 abut the photosensitive drum 1 with an intruding amount of 1 mm and an abutting nip portion width of 5 mm.

In the case of this embodiment, the supporting member 79 receives rotational drive, which is transmitted to the photosensitive drum 1 from a driving motor (not shown) of the image forming apparatus, via a gear train so as to be driven to move back and forth (or reciprocate) in the longitudinal direction by a constant stroke. Thus, the brush portion 61 of the developer charge amount control means 6 and the brush portion 71 of the residual developer uniformalizing means 7 slide in contact with the surface of the photosensitive drum 1. In this embodiment, the stroke d of the reciprocating movement (or reciprocating amount) is designed to be 5 mm.

Figure 2:
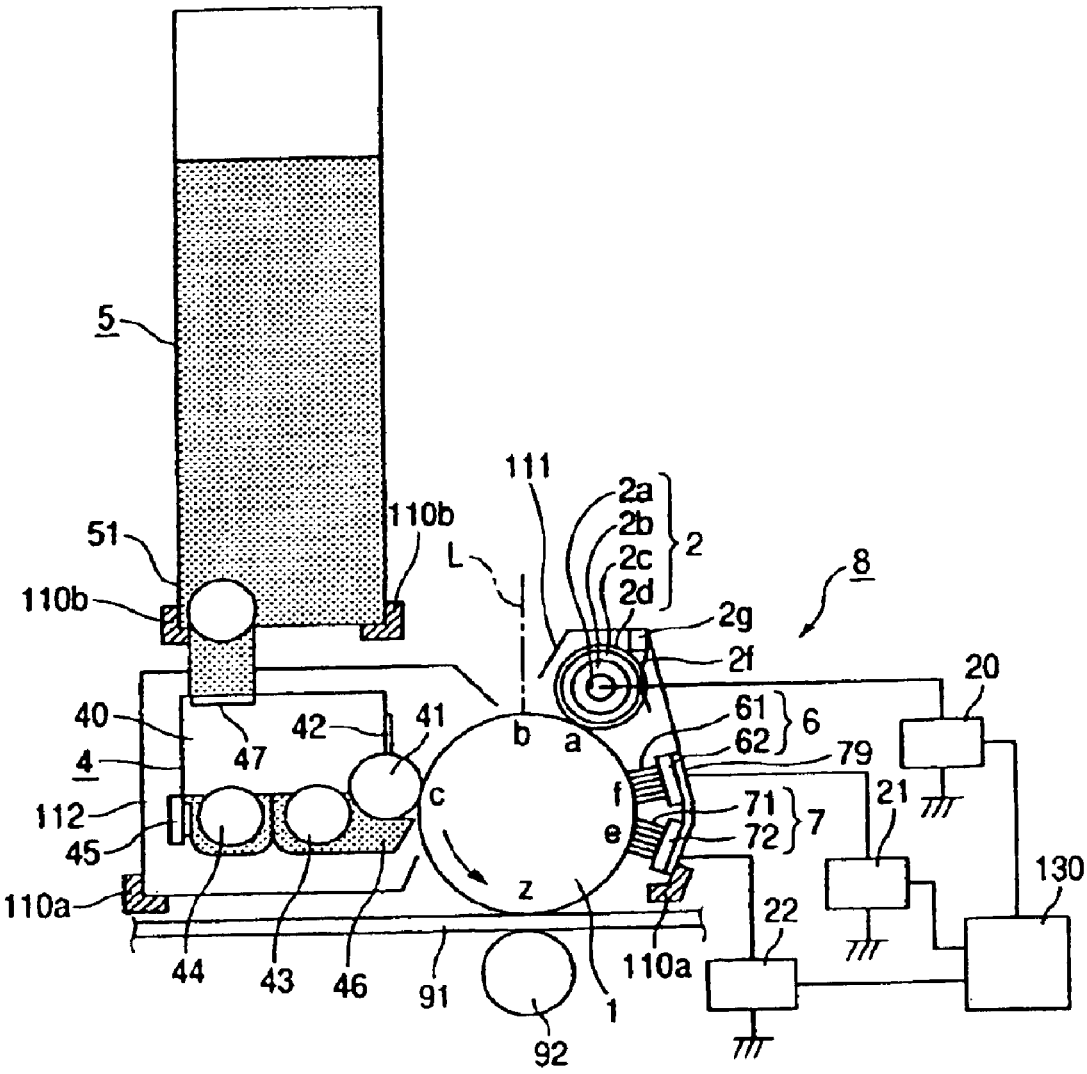
FIG. 2 is a cross sectional view schematically showing a process cartridge adapted to be attached to the image forming apparatus shown in FIG. 1.

As shown in FIG. 2, in the arrangement according to this embodiment, the residual developer uniformalizing means (or the second developer charging means) 7, and the developer charge amount control means (or the first developer charging means) 6 are disposed in the downstream side of the transferring portion z and the upstream side of the charging portion a with respect to the direction of the rotation of the photosensitive drum and arranged in the mentioned order from the upstream side. The residual developer uniformalizing means 7 forms a contact portion e with the photosensitive drum 1 and the developer charge amount control means 6 forms a contact portion f with the photosensitive drum 1.

In the case of this embodiment, a DC voltage of negative polarity that is the same as the normal charge polarity of the developer is applied to the developer charge amount control means 6 by a power source 21 serving as a voltage applying means. On the other hand, a voltage in which a DC voltage having positive polarity that is reverse to the normal charge polarity of the developer and an AC voltage are superimposed is applied to the residual developer uniformalizing means 7 by a power source 22 serving as voltage applying means.

The voltage applying means, such as power sources 20, 21, 22 equipped in the image forming apparatus 100 are controlled by a control circuit 130 serving as control means for performing overall control of the operations of the apparatus provided in the body of the image forming apparatus.

In this embodiment, the photosensitive drum 1, the charging roller 2, the charging roller cleaning member 2*f*, the developer 4, the residual toner uniformalizing means 7, and the toner charge amount control means 6 are integrated as a cartridge by a charge unit frame 111 and a developing frame 112 to form a process cartridge 8. The process cartridge 8 is detachably attached (or mounted) via attaching means 110*a* provided on the body of the image forming apparatus. Under the state in which the process cartridge 8 is attached to the body of the image forming apparatus, driving means (not shown) provided in the body of the image forming apparatus and drive transmission means provided in the process cartridge are connected, so that the state that enables driving of the photosensitive drum 1, the developing device 4 and the charging roller 2 etc. is realized. In addition, under the state in which the process cartridge 8 is attached to the body of the apparatus, various voltage applying means, such as power sources 20, 21 and 22, for applying bias voltages to the residual toner uniformalizing means 7 and the power source (not shown) for applying a bias to the developing sleeve 41 are in electrical contact with their objects via contact points provided on the process cartridge 8 and the body of the image forming apparatus.

The toner replenishing unit 5 is detachably attached to the developing device 4 and the body of the image forming apparatus via attaching means 110*b*. With the detachability of the process cartridge 8 and the toner replenishing unit 5 to the body of the image forming apparatus, replacement of consumable supplies or maintenance of the apparatus can be performed by a user when for example, the service life of the photosensitive drum 1 expires or the replenishing toner runs out, by for example, replacing the process cartridge. Thus, operationality and ease of maintenance are greatly improved.

Next, operations of the residual toner uniformalizing means 7 and the toner charge amount control means 6 will be detailed hereinbelow.

The developing device 4 causes fog toner to adhere to the surface of the photosensitive drum 1, though the amount of the fog toner is small. The fog toner includes toner having a charge polarity reverse to the normal charge polarity (i.e. having positive polarity, in this embodiment) and toner that has little charge. In addition, there is transfer residual toner on the photosensitive drum 1 after the transferring process, though the amount of the transfer residual toner is small. The transfer residual toner includes toner with a negative polarity (i.e. the normal polarity) in the image portion, toner with a positive polarity (i.e. the reverse polarity) in the non-image portion and toner whose polarity has been reversed into positive polarity by the influence of a positive transferring voltage (reversely charged toner).

The developer charge amount control means 6 and the residual developer uniformalizing means 7 control the charge amount of such toner having positive polarity, toner having the reverse polarity, and toner having little charge amount so as to prevent adhesion of toner to the charging roller 2 and to increase toner recovery in the developing device 4.

The residual developer uniformalizing means 7 makes the charge polarity of the residual toner on the photosensitive drum 1 after the transferring process uniformly positive. At the same time, the surface potential of the photosensitive drum 1 is also made uniform. The residual toner on the photosensitive drum 1 is then strongly charged with negative polarity by the developer charge amount control means 6. In other words, the charge polarity of the residual toner is made same as the charge polarity of the charger 2. Consequently, the residual toner on the photosensitive drum 1 is prevented from adhering to the charging roller 2, even when it passes by the charging roller 2 serving as the charger. In addition, since the toner that has been charged by the developer charge amount control means is strongly charged to a positive polarity, it is hard to be recovered in the developing device 4. Therefore, it is preferable that the residual toner on the photosensitive drum 1 be subjected to static reduction by the charging roller 2 as it passes by the charging roller 2. The static reduction of the residual toner by the charging roller 2 is realized by an effect of an oscillating voltage (especially an AC voltage) applied to the charging roller 2. The residual toner that has an appropriate negative charge amount due to the static reduction by the charging roller 2 is recovered by a recovering operation that is performed simultaneous with the developing operation by the developing device 4. Alternatively, the residual toner may be recovered by the intermediate transferring member (or a transferring belt for carrying and conveying transferring materials).

The developer charge amount control means 6 and the residual developer uniformalizing means 7 are reciprocated by a constant stroke in the longitudinal direction of the photosensitive drum 1. With this movement, it is possible to avoid local excessive charging of the transfer residual toner with respect to the longitudinal direction of the photosensitive drum 1 and to obtain a satisfactory image free from fusion of toner on the surface of the photosensitive drum 1.

However, with a change in the positional relationship between the developer carrying portion (i.e. the portion coated with developer) and the developer charge amount control means 6 and the residual developer uniformalizing means 7 caused by the reciprocating movement of the developer charge amount control means 6 and the residual developer uniformalizing means 7, the aforementioned problems (1) and (2) sometimes arise.

Figure 3:
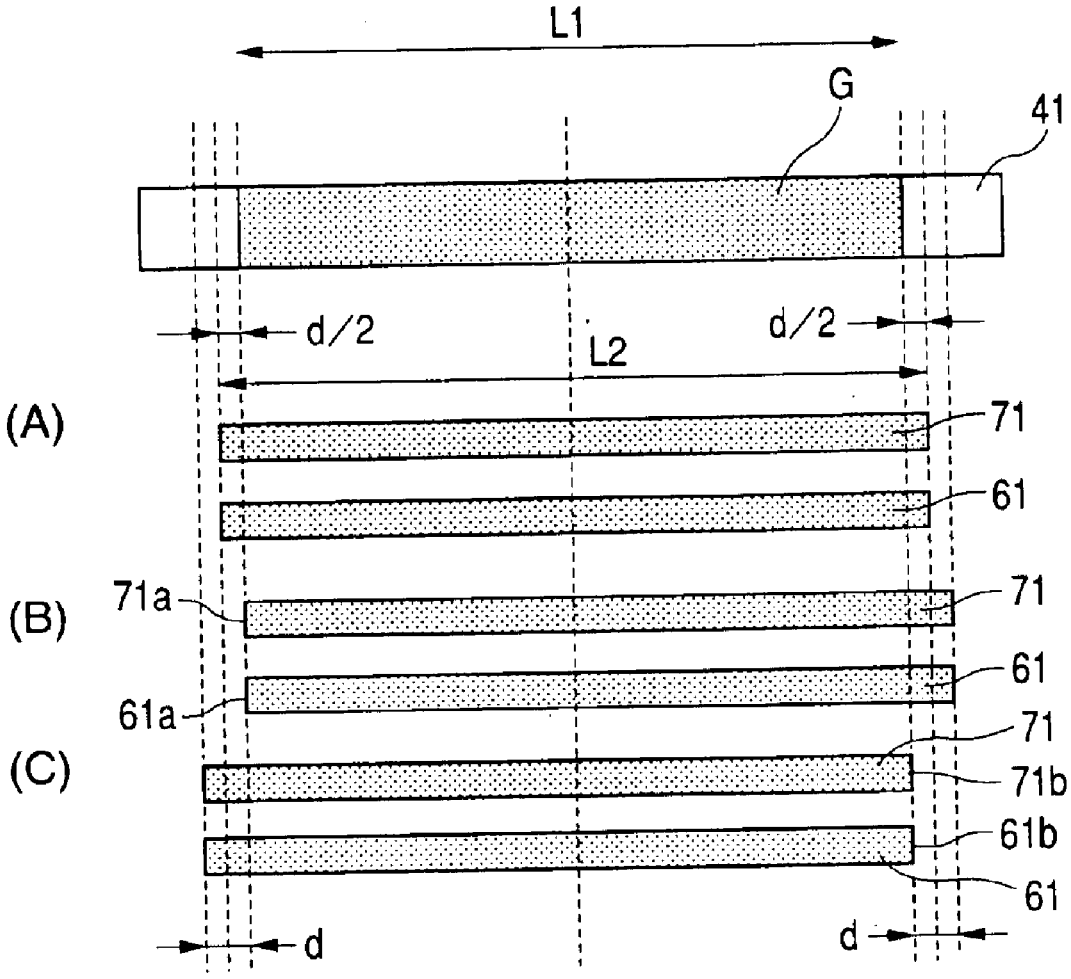
FIG. 3 is a schematic diagram showing the relationship of the longitudinal length (or the developing width) of a developer coating portion of a developing sleeve and the longitudinal length of developer charge amount control means and residual developer uniformalizing means.

FIG. 3 shows the positional relationship between the developer carrying portion G of the developing sleeve 41, or the developing area on the photosensitive drum 1, and the end faces of the brush portion (which will be referred to as the first brush hereinafter) 61 of the developer charge amount control means 6 and the brush portions (which will be referred to as the second brush hereinafter) 71 of the residual developer uniformalizing means 7, namely the side end faces (A to C) of the portion in contact with the photosensitive drum 1 with respect to the axial direction (i.e. the longitudinal direction) of the photosensitive drum 1.

Position (A) shown in FIG. 3 is the reference position of the first brush 61 and the second brush 71, in which the longitudinal centers of the first brush 61, the second brush 71 and the developer carrying portion G are on the same line.

On the other hand, position (B) is one of the marginal positions (the rightmost position in FIG. 3) of the reciprocating movement of the first brush 61 and the second brush 71, and position (C) is the other marginal position (the leftmost position in FIG. 3).

In this embodiment, the longitudinal length of the first brush 61 and the longitudinal length of the second brush 71 are the substantially the same (indicated by L2 in FIG. 3).

It is necessary that the left end faces 61*a* and 71*a* in FIG. 3 be positioned outside the range of the developer carrying portion G of the developing sleeve 41 even when the first brush 61 and the second brush 71 are in position (B) in the course of the reciprocation movement (with a stroke or movement amount d). It is also necessary that the right end faces 61*b* and 71*b* in FIG. 3 be positioned outside the range of the developer carrying portion G of the developing sleeve 41 even when the first brush 61 and the second brush 71 are in position (C).

The above conditions are necessary in order to prevent generation of an abnormal image due to charging error that might be caused in the situation that fog toner or transferring residual toner is in direct contact with the charging roller 2 without passing through the first brush 61 and the second brush 71 to adhere to the charging roller 2.

Thus, the apparatus is arranged in such a way that the end faces of the first brush 61 and the second brush 71 are kept outside the range of the developer carrying portion G of the developing sleeve 41 certainly even during the reciprocating movement. Specifically, the relationship of the longitudinal length L1 (mm) of the developer carrying portion of the developing sleeve (i.e. the developing width L1 (mm) of the developing area) and the longitudinal length L2 of the first brush 61 and the second brush 71 satisfies the following condition (1).

$$L1+d \leqq L2 \quad (1)$$

With this condition, fog toner or transfer residual toner is prevented from being brought into contact with the charging roller 2 directly, so that generation of an abnormal image due to charging error can be avoided. In this embodiment the length L1 is designed to be 310 mm, the length L2 is designed to be 320 mm, and the length d is designed to be 5 mm.

Figure 4:
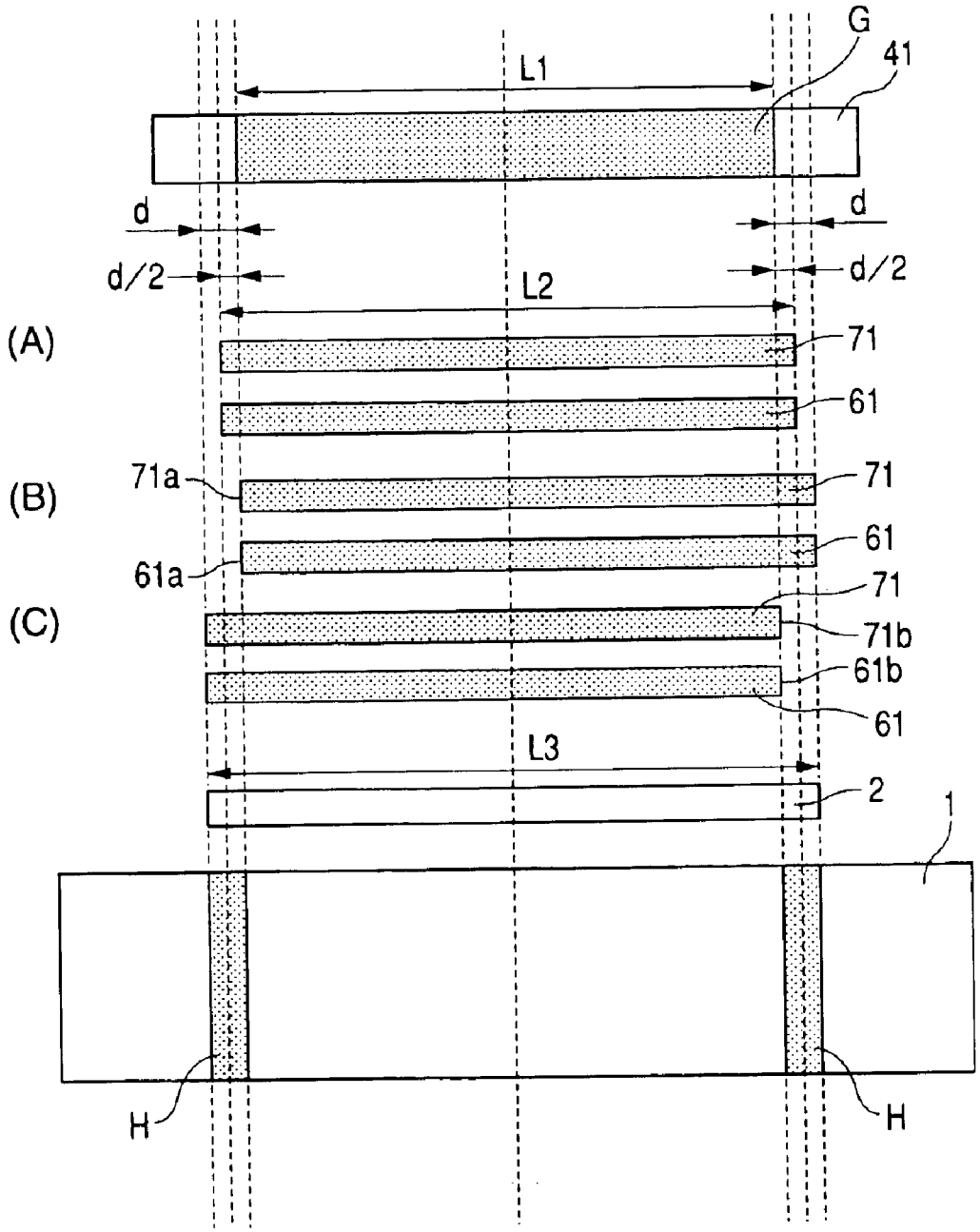
FIG. 4 is a schematic diagram showing the relationship of the longitudinal length of a developer carrying portion (or the developing width) of a developing sleeve, the longitudinal length of developer charge amount control means and residual developer uniformalizing means, the longitudinal length of a charging roller and a coating portion of a photosensitive drum.

FIG. 4 shows positional relationship of the developer carrying portion G of the developing sleeve 41, the end faces of the first brush 61 and the second brush 71, and the charging processing portion of the charging roller 2 and the photosensitive layer coating portion (i.e. the chargeable portion) of the photosensitive drum 1.

Position (A) shown in FIG. 4 is the reference position of the first brush 61 and the second brush 71, in which the longitudinal centers of the first brush 61, the second brush 71, the developer carrying portion G, the charging processing portion of the charging roller 2 and the coating portion of the photosensitive drum 1 are on the same line. On the other hand, position (B) is one of the marginal positions (the rightmost position in FIG. 4) of the reciprocating movement of the first brush 61 and the second brush 71, and position (C) is the other marginal position (the leftmost position in FIG. 4).

Under the setting that the longitudinal length L1 (mm) of the developer carrying portion G of the developing sleeve 41 and the longitudinal length L2 (mm) of the first brush 61 and the second brush 71 satisfy the aforementioned condition (1), there is an area in the portion of the first brush 61 and the second brush 71 on which toner is adhering and that is brought to outside the range of the developer carrying portion G of the developing sleeve 41 in the course of the reciprocating movement.

As described before, since the fog toner and the transfer residual toner have been controlled by the developer charge amount control means 6 and the residual developer uniformalizing means 7 to have a normal charge polarity and appropriate charge amounts, they scarcely adhere to the charging roller 2. However, the toner adhering on the first brush 61 and the second brush 71 that have been brought to outside the range of the developer carrying portion G of the developing sleeve 41 cannot be recovered by the developer carrying portion G of the developing sleeve 41. As a result, toner might adhere and accumulate on the surface of the photosensitive drum 1 in portion H shown in FIG. 4, so that problems such as toner scattering sometimes arise.

Given the above-described situation, the inventors made strenuous studies and devised the following method for removing and recovering the toner adhering accumulating on the surface of the photosensitive drum 1.

Figure 5:
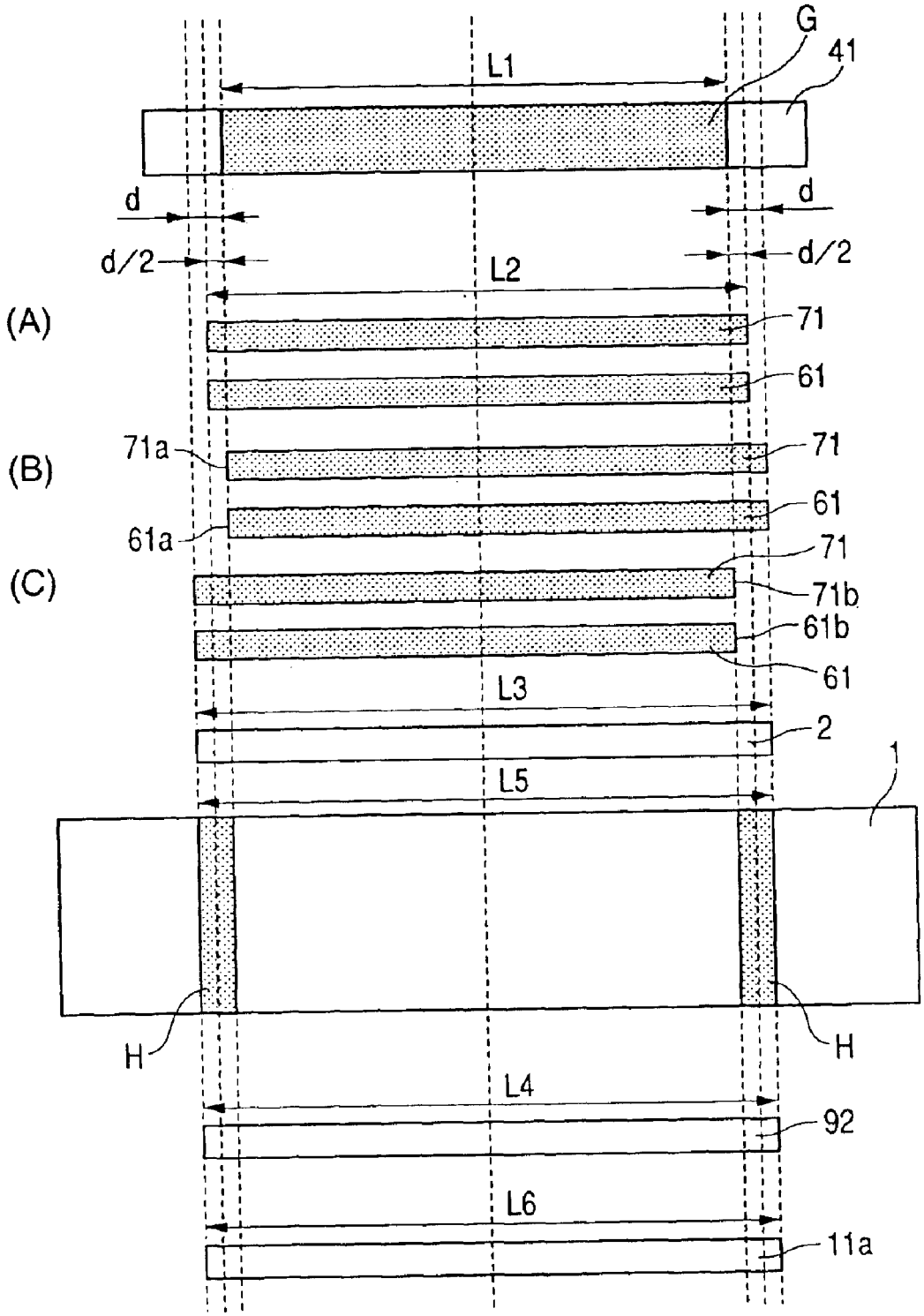
FIG. 5 is a schematic diagram showing the relationship of the longitudinal length of a developer carrying portion (or the developing width) of a developing sleeve, the longitudinal length of developer charge amount control means and residual developer uniformalizing means, the longitudinal length of a charging roller, the longitudinal length of a coating portion of a photosensitive drum, the longitudinal length of a primary transfer roller and the longitudinal length of a cleaning blade of an intermediate transferring belt cleaner.

FIG. 5 shows the positional relationship of the developer carrying portion G of the developing sleeve 41, the end faces of the first brush 61 and the second brush 71, the charging processing portion of the charging roller 2, the photosensitive layer coating portion of the photosensitive drum 1, the operating portion of the primary transfer roller 92 and the operating portion of the cleaning blade 1 a equipped in the intermediate transferring belt cleaner 11.

Position (A) shown in FIG. 5 is the reference position of the first brush 61 and the second brush 71, in which the longitudinal centers of the first brush 61, the second brush 71, the developer carrying portion G, the charging processing portion of the charging roller 2 and the photosensitive layer coating portion of the photosensitive drum 1, the operating portion of the primary transfer roller 92 and the operating portion of the cleaning blade 11*a* are on the same line. On the other hand, position (B) is one of the marginal positions (the rightmost position in FIG. 5) of the reciprocating movement of the first brush 61 and the second brush 71, and position (C) is the other marginal position (the leftmost position in FIG. 5) of the reciprocating movement.

First, the toner adhering on the photosensitive drum 1 that cannot be recovered by the developer carrying portion G of the developing sleeve 41 (i.e. the toner in portions H shown in FIG. 5) is transferred and caused to adhere to the intermediate transferring belt 91 in the transferring portion d at any time.

In order for the toner adhering on portions H of the photosensitive drum 1 to be transferred and caused to adhere to the intermediate transferring belt 91 at any time, it is necessary that the charge of the toner is controlled to have a normal polarity and an appropriate charge amount. As described before, the charge amount of the toner that have passed through the developer charge amount control means 6 and the residual developer uniformalizing means 7 is too high and the mirroring force with the photosensitive drum 1 is too strong, so that it cannot be transferred to the intermediate transferring belt 91.

Consequently, as described above, it is preferable that that toner be subjected to static elimination by an AC voltage applied to the charging roller 2. For that purpose, it is necessary that the longitudinal length of the charging roller 2 extend to the area outside the range of the developer carrying portion G of the developing sleeve 41 into which the portion of the first brush 61 and the second brush 71 on which toner is adhering is brought in the course of the reciprocating movement. Specifically, the apparatus is designed in such a way that the relationship between the longitudinal length L1 (mm) of the developer carrying portion G of the developing sleeve 41 and the longitudinal length L3 (mm) of the charging portion (or the charging width) of the charging roller 2 satisfies the following condition (2).

$$L1+2\times d \leqq L3 \quad (2)$$

With this condition, it is possible to make the residual toner adhere on portion H of the photosensitive drum 1 in contact with the charging roller 2 reliably, so that the residual toner is caused to have appropriate an charge amount with a normal polarity by virtue of the static elimination effect of the AC voltage applied to the charging roller 2. In practice, the length L3 is designed to be 320 mm, in this embodiment. As a result, the toner adhering on the photosensitive drum 1 can be transferred to the intermediate transferring belt 91 so as to be removed from the photosensitive drum 1.

Furthermore, in order for the residual toner on the photosensitive drum 1 to be recovered onto the intermediate transferring belt all over the longitudinal area of the photosensitive drum 1, it is necessary that the longitudinal length of the operating portion of the primary transfer roller 92 extend to the area outside the range of the developer carrying portion G of the developing sleeve 41 into which the portion of the first brush 61 and the second brush 71 on which toner is adhering is brought in the course of the reciprocating movement. Specifically, the apparatus is designed in such a way that the relationship between the longitudinal length L1 (mm) of the developer carrying portion G of the developing sleeve 41 and the length of the operating portion (or transferring width) L4 (mm) of the primary transfer roller 92 satisfies the following condition (3).

$$L1+2\times d \leqq L4 \quad (3)$$

In practice, the length LA is designed to be 330 mm, in this embodiment.

Furthermore, it is necessary that the charging roller be in contact with the coating portion of the photosensitive drum 1 that has been charged. This is necessary in order to avoid leakage of a current from the charging roller 2 to the photosensitive drum 1. Consequently, the apparatus is designed in such a way that the relationship between the longitudinal length of the chargeable coating portion (or coating width) L5 (mm) of the photosensitive drum 1 and the charging width L3 (mm) of the charging roller 2 satisfies the following condition (4).

$$L3 \leqq L5 \quad (4)$$

In practice, the length L5 is designed to be 340 mm.

Then, the toner transferred and attached to the intermediate transferring belt 91 at any time can be recovered by the intermediate transferring belt cleaner 11. For that purpose, it is necessary that the longitudinal length of the operating portion of the cleaning blade 11*a* equipped in the intermediate transferring belt cleaner 11 extend to the area outside the range of the developer carrying portion G of the developing sleeve 41 into which the portion of the first brush 61 and the second brush 71 on which toner is adhering is brought in the course of the reciprocating movement. Specifically, the apparatus is designed in such a way that the relationship between the longitudinal length L1 (mm) of the developer carrying portion G of the developing sleeve 41 and the longitudinal length L6 of the operating portion of the cleaning blade 11*a* satisfies the following condition (5).

$$L1+2\times d \leqq L6 \quad (5)$$

In practice, the length L6 is designed to be 330 mm, in this embodiment.

In addition, similar to the case of the aforementioned charging roller, in order to prevent current leakage from the first brush 61 to the photosensitive drum 1, the apparatus is designed in such a way that the relationship between the longitudinal length L2 of the first brush 61 and the coating width L5 of the photosensitive drum 1 satisfies the following condition (6).

$$L2 \leqq L5-d \quad (6)$$

In addition, it is normally preferable that the conditions $L4 \leqq L5$ and $L6 \leqq L5$ are met.

As per conditions (1) to (6), it was turned out that it is advantageous that the length L1 (mm) of the developer carrying portion G of the developing sleeve 41, the length L2 (mm) of the first brush 61 and the second brush 71, the charging width L3 (mm) of the charging roller 2, the length L4 (mm) of the operating portion of the primary transfer roller 92, the coating width L5 (mm) of the photosensitive drum 1, the length L6 (mm) of the operating portion of the cleaning blade 11 a and the reciprocating amount (or stroke) d (mm), all in the direction substantially parallel to the longitudinal direction of the photosensitive drum 1 satisfy the following conditions.

$$L1+d \leqq L2 \leqq L5-d$$

$$L1+2\times d \leqq L3 \leqq L5$$

$$L1+2\times d \leqq L4$$

$$L1+2\times d \leqq L6$$

We performed image formation with the image forming apparatus according to this embodiment designed in compliance with the above conditions, and it was confirmed that abnormal images, such as fogged images, were greatly suppressed and toner scattering, due to accumulation of toner on the photosensitive drum 1, was dramatically improved.

As per the above, according to this embodiment, with the design in which the end faces of the first brush 61 and the second brush 71 stay outside the range of the developer carrying portion G of the developing sleeve 41 even during reciprocating movement of the developer charge amount control means 6 and the residual developer uniformalizing means 7, it is possible to positively prevent the generation of abnormal images due to charging error caused by toner adhering to the charging roller 2 and bringing about toner contamination beyond an acceptable degree.

In addition, in the case that the end faces of the first brush 61 and the second brush 71 are once brought inside the range of the developer carrying portion G of the developing sleeve 41, so that toner adheres to the surface of the first brush 61 and the second brush 71 and then the portion in which the toner is adhering is brought to outside the range of the developer carrying portion G of the developing sleeve 41 in the course of the reciprocation movement, it is possible to transfer and attach the toner adhering on the photosensitive drum 1 that cannot be recovered by the developing device onto the intermediate transferring belt 9 by means of the primary transfer roller 92, by appropriately designing the relationship of the movement stroke d of the developer charge amount control means 6 and the residual developer uniformalizing means 7, the longitudinal length L1 of the developer carrying portion G of the developing sleeve 41, the longitudinal length L2 of the first brush 61 and the second brush 71, the charging width L3 of the charging roller 2, the longitudinal length L4 of the operating portion of the primary transfer roller 92, and the coating width L5 of the photosensitive drum 41.

Furthermore, with the appropriate design of the longitudinal length L6 of the operating portion of the cleaning blade 11 a equipped in the intermediate transferring belt cleaner 11, it is possible to recover toner adhering on the intermediate transferring belt 91 by means of that cleaner, so that problems such as toner scattering due to accumulation of toner on the photosensitive drum 1 can be avoided positively. In addition, it is not necessary to provide special cleaning means for recovering the toner that has been transferred onto the intermediate transferring belt without being recovered by the developing apparatus. Therefore, the structure of the apparatus can be made simple.

While in the above-described embodiment the developer charge amount control means 6 and the residual developer uniformalizing means 7 are fixed to the same support member 79 and caused to reciprocate together, the present invention is not restricted by this feature. The structure may be modified in such a way that only the developer charge amount control means 6 is reciprocated. Alternatively, the developer charge amount control means 6 and the residual developer uniformalizing means 7 may be reciprocated independently from each other so long as the toner that have left the residual developer uniformalizing means 7 and advances toward downstream of the rotation of the photosensitive drum 1 can be subjected to the effect of the developer charge amount control means 6 positively. In addition, the present invention is also effectively applicable to systems that have only the developer charge amount control means 6.

In the above-described embodiment, the transfer destination member onto which toner is transferred from the respective image forming portions PY, PM, PC and PBk is an intermediate transferring member. However, as is well known to those skilled in the art, there is an image forming apparatus provided with, in place of the intermediate transferring member, a transferring material carrying member that carries a transferring material such as a recording paper sheet and conveys it to multiple image forming portions sequentially. In such an image forming apparatus, toner images are sequentially transferred from the respective image forming portions (or image forming stations) onto the transferring material on the transferring material transferring member in a multi-layered manner, and then the transferring material is detached from the transferring material carrying member and conveyed to fixing means, in which an unfixed toner image is fixed, so that a color image is obtained. The present invention can also be applied to this type of image forming apparatus. In that case, the apparatus can be designed in a manner similar to the above-described apparatus provided with the intermediate transferring member, namely, in such a way that toner is transferred from the respective image forming portions onto the transferring material carrying member serving as a transfer destination member so as to be caused to adhere on the transferring material and then the toner on the transferring material carrying member is removed and recovered by cleaning means such as a cleaning blade.

While in the above-described embodiment, the developer charge amount control means 6 and the residual developer uniformalizing means 7 are constructed as fixed brush-like members, they may be changed to members of any other form such as sheet-like members.

The photosensitive drum 1 may be of a direct charge-injection type provided with a charge injection layer having a surface volume resistivity of $10^9$ to $10^{14}\Omega\cdot$cm. Even if the charge injection layer is not provided, in the case, for example, that a charge transfer layer has a resistance within the above range, the same effect can be realized. In addition, the photosensitive drum 1 may be an amorphous silicone photosensitive member having a surface volume resistivity of about $10^{13}\Omega\cdot$cm.

The shape or material of the elastic contact charging member may be a fur brush, a felt or a fabric in addition to the charging roller. Furthermore, more appropriate elasticity, electric conductivity, surface property or durability might be realized by a combination of various materials.

The waveform of an oscillating voltage component (i.e. an AC component or a voltage that changes periodically in its value) may be a sinusoidal wave, a rectangular wave or a triangular wave. It may be a rectangular wave formed by turning on and off a DC power source periodically.

The image exposure means serving as information writing means for the charged surface of the photosensitive member, functioning as an image bearing member, may be digital exposure means utilizing an array of solid state light emitting elements such as LEDs, besides the laser scanning means used in the embodiment. Alternatively, it may be an analog image exposure means using a halogen lamp or a fluorescent lamp as a light source for illuminating originals. In short, the image exposure means may be any means so long as it can form an electrostatic latent image corresponding to image information.

As has been described in the foregoing, according to the present invention, efficiency of removal and recovery of transfer residual developer from an image bearing member provided with developer charging means movable in the longitudinal direction of the image bearing member is enhanced. Even in the case that the developer charging means is moved, it is possible to suppress adhesion of developer to a charger so as to avoid formation of abnormal images due to charging error. In addition, according to the present invention, it is possible to suppress the accumulation of developer on the image bearing member so as to avoid toner scattering, even when the developer charging means is moved.

What is claimed is:

1. A process cartridge detachably attachable to a body of an image forming apparatus, comprising:

an image bearing member;

a developing device configured and positioned to develop an electrostatic image formed on said image bearing member by using developer to form a developer image on said image bearing member; and a developer charger configured and positioned to charge residual developer on said image bearing member disposed downstream, with respect to a moving direction of said image bearing member, of a transferring position at which said developer image is transferred onto a transfer member and upstream, with respect to the moving direction of said image bearing member, of a position at which the electrostatic image is formed on said image bearing member, said developer charger being disposed to contact said image bearing member, and said developer charger being movable in a direction substantially the same as the longitudinal direction of said image bearing member upon charging said residual developer, wherein in the direction substantially the same as the longitudinal direction of said image bearing member, when L1 denotes the developing width of said developing device, L2 denotes the contact width of said developer charger with said image bearing member, and d denotes the width of movement of said developer charger, the following condition is satisfied:

$$L1+d \leqq L2.$$

2. A process cartridge according claim 1, further comprising a charging device configured and positioned to charge said image bearing member for allowing formation of said electrostatic image, wherein when L3 denotes the charging width of said charging device in a direction substantially the same as the longitudinal direction of said image bearing member, the following condition is satisfied:

$$L1+2d \leqq L3.$$

3. A process cartridge according to claim 2, wherein when L5 denotes the length of a chargeable portion of said image bearing member in a direction substantially the same as the longitudinal direction of the image bearing member, the following condition is satisfied:

$$L3 \leqq L5.$$

4. A process cartridge according to claim 2, wherein said charging device is disposed in contact with said image bearing member.

5. A process cartridge according to claim 2, wherein an oscillating voltage is applied to said charging device.

6. A process cartridge according to claim 5, wherein said charging device reduces the charge amount of developer remaining on said image bearing member.

7. A process cartridge according to claim 1, wherein the body of the apparatus has a transferring device configured and positioned to transfer the developer image onto the transfer member at the transferring position, and wherein when L4 denotes the transferring width of the transferring device in a direction substantially the same as the longitudinal direction of said image bearing member, the following condition is satisfied:

$$L1+2d \leqq L4.$$

8. A process cartridge according to claim 1, wherein when L5 denotes the length of a chargeable portion of said image bearing member in a direction substantially the same as the longitudinal direction of said image bearing member, the following condition is satisfied:

$$L2 \leqq L5-d.$$

9. A process cartridge according to claim 1, wherein the body of the apparatus includes:

a transferring device configured and positioned to transfer the developer image onto the transfer member at the transferring position; and a cleaning device configured and positioned to remove developer on the transfer member, and wherein when L6 denotes the cleaning width of the cleaning device in a direction substantially the same as the longitudinal direction of the image bearing member, the following condition is satisfied:

$$L1+2d \leqq L6.$$

10. A process cartridge according to claim 1, wherein upon charging said residual developer, said developer charger can reciprocate in a direction substantially the same as the longitudinal direction of said image bearing member.

11. A process cartridge according to claim 1, wherein a DC voltage having a charge polarity the same as a normal charge polarity of the developer is applied to said developer charger.

12. A process cartridge according to claim 1, wherein said developer charger has a fiber brush portion that is in contact with said image bearing member.

13. A process cartridge according to claim 1, wherein said developing device is capable of recovering residual developer on said image bearing member.

14. A process cartridge according to claim 1, further comprising a second developer charger configured and positioned to charge residual developer on said image bearing member with a charge polarity reverse to a normal charge polarity of developer that is disposed downstream, with respect to the moving direction of said image bearing member, of the transferring position and upstream, with respect to the moving direction of said image bearing member, of said developer charger, said second developer charger being disposed to contact said image bearing member, and said second developer charger being movable in a direction substantially the same as the longitudinal direction of said image bearing member.

15. A process cartridge according to claim 14, wherein said second developer charger is capable of reciprocating in a direction substantially the same as the longitudinal direction of the image bearing member.

16. A process cartridge according to claim 14, wherein said second developer charger has a fiber brush portion that is in contact with said image bearing member.

17. A process cartridge according to claim 14, wherein the contact width of said second developer charger and said image bearing member is substantially the same as the contact width of said developer charger and said image bearing member in a direction substantially the same as the longitudinal direction of said image bearing member, and wherein the width of movement of said second developer charger is substantially the same as the width of movement of said developer charger.

18. An image forming apparatus comprising:

an image bearing member:

a developing device configured and positioned to develop an electrostatic image formed on said image bearing member by using developer to form a developer image on said image bearing member; and a developer charger configured and positioned to charge residual developer on said image bearing member disposed downstream, with respect to a moving direction of said image bearing member, of a transferring position at which said developer image is transferred onto a transfer member and upstream, with respect to the moving direction of said image bearing member, of a position at which the electrostatic image is formed on said image bearing member, said developer charger being disposed to contact said image bearing member, and said developer charger being movable in a direction substantially the same as the longitudinal direction of said image bearing member upon charging said residual developer, wherein in a direction substantially the same as the longitudinal direction of said image bearing member, when L1 denotes the developing width of said developing device, L2 denotes the contact width of said developer charger with said image bearing member, and d denotes the width of movement of said developer charger, the following condition is satisfied:

$$L1+d \leqq L2.$$

19. An image forming apparatus according claim 18, further comprising a charging device configured and positioned to charge said image bearing member for allowing formation of said electrostatic image, wherein when L3 denotes the charging width of said charging device in a direction substantially the same as the longitudinal direction of said image bearing member, the following condition is satisfied:

$$L1+2d \leqq L3.$$

20. An image forming apparatus according to claim 19, wherein when L5 denotes the length of a chargeable portion of said image bearing member in a direction substantially the same as the longitudinal direction of the image bearing member, the following condition is satisfied:

$$L3 \leqq L5.$$

21. An image forming apparatus according to claim 19, wherein said charging device is disposed in contact with said image bearing member.

22. An image forming apparatus according to claim 19, wherein an oscillating voltage is applied to said charging device.

23. An image forming apparatus according to claim 22, wherein said charging device reduces the charge amount of developer remaining on said image bearing member.

24. An image forming apparatus according to claim 18, further comprising a transferring device configured and positioned to transfer the developer image onto the transfer member at the transferring position, wherein when L4 denotes the transferring width of said transferring device in a direction substantially the same as the longitudinal direction of said image bearing member, the following condition is satisfied:

$$L1+2d \leqq L4.$$

25. An image forming apparatus according to claim 18, wherein when L5 denotes the length of a chargeable portion of said image bearing member in a direction substantially the same as the longitudinal direction of said image bearing member, the following condition is satisfied:

$$L2 \leqq L5-d.$$

26. An image forming apparatus according to claim 18, further comprising:

a transferring device configured and positioned to transfer the developer image onto the transfer member at the transferring position; and a cleaning device configured and positioned to remove developer on the transfer member, wherein when L6 denotes the cleaning width of said cleaning device in a direction substantially the same as the longitudinal direction of the image bearing member, the following condition is satisfied:

$$L1+2d \leqq L6.$$

27. An image forming apparatus according to claim 18, further comprising:

a carrying member configured and positioned to carry the transfer member and conveying the transfer member to the transferring position;

a transferring device configured and positioned to transfer the developer image onto the transfer member at the transferring position; and a cleaning device configured and positioned to remove developer on said image bearing member, wherein when L6 denotes the cleaning width of said cleaning device in a direction substantially the same as the longitudinal direction of said image bearing member, the following condition is satisfied:

$$L1+2d \leqq L6.$$

28. An image forming apparatus according to claim 18, wherein upon charging said residual developer, said developer charger can reciprocate in a direction substantially the same as the longitudinal direction of said image bearing member.

29. An image forming apparatus according to claim 18, wherein a DC voltage having a charge polarity the same as a normal charge polarity of the developer is applied to said developer charger.

30. An image forming apparatus according to claim 18, wherein said developer charger has a fiber brush portion that is in contact with said image bearing member.

31. An image forming apparatus according to claim 18, wherein said developing device is capable of recovering residual developer on said image bearing member.

32. An image forming apparatus according to claim 18, further comprising:

a second developer charger configured and positioned to charge residual developer on said image bearing member with a charge polarity reverse to a normal charge polarity of developer disposed downstream, with respect to the moving direction of said image bearing member, of the transferring position and upstream, with respect to the moving direction of said image bearing member, of said developer charger, said second developer charger being disposed to contact said image bearing member, and said second developer charger being movable in a direction substantially the same as a longitudinal direction of said image bearing member.

33. An image forming apparatus according to claim 32, wherein said second developer charge is capable of reciprocating in a direction substantially the same as the longitudinal direction of said image bearing member.

34. An image forming apparatus according to claim 32, wherein said second developer charger has a fiber brush portion that is in contact with said image bearing member.

35. An image forming apparatus according to claim 32, wherein the contact width of said second developer charger and said image bearing member is substantially the same as the contact width of said developer charger and said image bearing member in a direction substantially the same as the longitudinal direction of said image bearing member, and wherein the width of movement of said second developer charger is substantially the same as the width of movement of said developer charger.

36. An image forming apparatus according to claim 18, further comprising a plurality of image forming stations each of which has said image bearing member, said developing device, and said developer charger, wherein developer images are transferred from said image bearing members of said respective image forming stations onto the transfer member that moves through said image forming stations.

37. An image forming apparatus according to claim 36, wherein the transfer member is an intermediate transferring member, and said developer image are transferred from said intermediate transferring member onto a transferring material.

38. An image forming apparatus according to claim 36, wherein the transfer member is a transferring material, and a transferring material carrying member that carries the transferring material moves through said image forming stations.

39. An image forming apparatus according to claim 36, wherein said image forming stations form developer images of different colors on the transfer member respectively.

* * * * *

UNITED STATES PATENT AND TRADEMARK OFFICE

CERTIFICATE OF CORRECTION

PATENT NO. : 6,922,539 B2
DATED : July 26, 2005
INVENTOR(S) : Masao Uyama et al.

It is certified that error appears in the above-identified patent and that said Letters Patent is hereby corrected as shown below:

Column 4,
Line 52, “toner” should read -- toner is --.

Column 5,
Lines 58 and 61, “cross sectional” should read -- cross-sectional --.

Column 6,
Line 38, “communicate” should read -- communicating --.

Column 10,
Line 48, “fitly” should be deleted.

Column 16,
Line 27, “1 a” should read -- 11a --.

Column 17,
Line 12, “an” should read -- a --.

Column 19,
Line 7, “11 a” should read -- 11a --.
Line 25, “have” should read -- has --.

Column 24,
Line 52, “charge” should read -- charger --.

UNITED STATES PATENT AND TRADEMARK OFFICE

CERTIFICATE OF CORRECTION

PATENT NO. : 6,922,539 B2
DATED : July 26, 2005
INVENTOR(S) : Masao Uyama et al.

It is certified that error appears in the above-identified patent and that said Letters Patent is hereby corrected as shown below:

Column 26,
Line 1, “image” should read -- images --.

Signed and Sealed this

Seventh Day of March, 2006

JON W. DUDAS
*Director of the United States Patent and Trademark Office*